US006128462A

United States Patent [19]

Kato et al.

[11] Patent Number: 6,128,462

[45] Date of Patent: Oct. 3, 2000

[54] CLEANING MEMBER, IMAGE FORMING APPARATUS PROVIDED WITH A CLEANING BLADE MEMBER, AND PROCESS CARTRIDGE DETACHABLY ATTACHABLE ON THE IMAGE FORMING APPARATUS

[75] Inventors: Junichi Kato, Toride; Satoru Inami, Kashiwa; Masahiro Yoshida; Yusuke Nakazono, both of Toride; Satoshi Sunahara, Funabashi; Seiichi Shinohara, Abiko, all of Japan

[73] Assignee: Canon Kabushiki Kaisha, Tokyo, Japan

[21] Appl. No.: 09/280,577

[22] Filed: Mar. 30, 1999

[30] Foreign Application Priority Data

Apr. 2, 1998 [JP] Japan ..... 10-090372

[51] Int. Cl.[7] ..... G03G 15/00; G03G 21/00

[52] U.S. Cl. ..... 399/350; 430/125

[58] Field of Search ..... 399/350, 111, 399/343, 161; 430/56, 58, 125, 96; 15/256.5, 1.51

[56] References Cited

U.S. PATENT DOCUMENTS

| | | | |
|---|---|---|---|
| 4,956,256 | 9/1990 | Ohtsuka et al. | 430/96 |
| 5,141,832 | 8/1992 | Takegawa et al. | 430/96 |
| 5,475,471 | 12/1995 | Kisu et al. | 399/115 |
| 5,543,899 | 8/1996 | Inami et al. | 399/176 |
| 5,568,242 | 10/1996 | Sasame et al. | 399/350 |
| 5,585,212 | 12/1996 | Ueda | 430/58 |
| 5,765,077 | 6/1998 | Sakurai et al. | 339/176 |
| 5,790,927 | 8/1998 | Ando et al. | 399/176 |
| 5,942,366 | 8/1999 | Ohno et al. | 430/125 |

FOREIGN PATENT DOCUMENTS 62-160458 7/1987 Japan .

*Primary Examiner*—Sophia S. Chen

*Attorney, Agent, or Firm*—Fitzpatrick, Cella, Harper & Scinto

[57] ABSTRACT

A cartridge detachably attachable on an image forming apparatus a photosensitive member as an image bearing member and a cleaning blade member polycarbonate resin having a viscosity average molecular weight of $1.5\times10^4$ or less is blended with the surface layer of the image bearing member, and the peak value of tan δ of the dynamic viscoelastic characteristic of the cleaning blade member appears at 12° C. or less.

20 Claims, 4 Drawing Sheets

GENERAL FORMULA

FIG. 7

| | ENDURANCE IN H/H ENVIRONMENT | ENDURANCE IN L/L ENVIRONMENT | |
|---|---|---|---|
| | EVALUATION RESULT OF SMEARED IMAGE | EVALUATION RESULT OF CLEANING PROPERTY | SURFACE ROUGHNESS Rz OF PHOTOSENSITIVE DRUM |
| EMBODIMENT 1 | NOT OCCURRED | GOOD | 1.3 $\mu$m |
| COMPARATIVE EXAMPLE 1 | NOT OCCURRED | POOR CLEANING OCCURRS AT 7000 SHEETS | 2.7 $\mu$m |
| COMPARATIVE EXAMPLE 2 | SMEARED IMAGE OCCURRS AT 4000 SHEETS | GOOD | 0.7 $\mu$m |
| COMPARATIVE EXAMPLE 3 | NOT OCCURRED | POOR CLEANING OCCURRS AT 1000 SHEETS | 3.1 $\mu$m |
| COMPARATIVE EXAMPLE 4 | SMEARED IMAGE OCCURRS AT 4000 SHEETS | GOOD | 0.7 $\mu$m |
| COMPARATIVE EXAMPLE 5 | NOT OCCURRED | POOR CLEANING OCCURRS AT 8000 SHEETS | 1.9 $\mu$m |

CLEANING MEMBER, IMAGE FORMING APPARATUS PROVIDED WITH A CLEANING BLADE MEMBER, AND PROCESS CARTRIDGE DETACHABLY ATTACHABLE ON THE IMAGE FORMING APPARATUS

BACKGROUND OF THE INVENTION

1. Field of the Invention

This invention relates to an image forming apparatus such as a copying apparatus, a laser printer or a facsimile apparatus, a process cartridge detachably attachable on the image forming apparatus, and a cleaning member for cleaning an image bearing member.

Particularly, the present invention relates to a cleaning member for cleaning the surface of an image bearing member, an image forming apparatus provided with the cleaning member, and process cartridge.

2. Related Background Art

FIG. 5 of the accompanying drawings schematically shows the construction of an image forming apparatus such as a copying apparatus or a laser printer. In FIG. 5, the letter M designates the main body of the image forming apparatus as a printer engine. The reference numeral 1 denotes a cylindrical photosensitive drum as an image bearing member rotatively driven in the direction of arrow R1 by driving means (not shown). The surface of the photosensitive drum 1 is uniformly charged by a charging device 2 disposed in contact therewith to form a charging nip portion $N_1$ and is rotated in the direction of arrow R2, whereafter an electrostatic latent image is formed thereon by an exposing device 3. A developing device (toner image forming means) is provided with a hopper, which is a toner containing device, for effecting the storage and custody of a toner T, and a developing sleeve 4*a*, which is a toner bearing member, and develops the electrostatic latent image formed on the photosensitive drum 1. A developing blade 4*b*, which is a toner regulating member, is installed near the developing sleeve 4*a* rotated in the direction of arrow R4. A developing bias, comprising an AC bias superposed on a DC bias, is supplied between the photosensitive drum 1 and the developing sleeve 4*a* by an engine control portion 8 provided with a power source for driving the image forming apparatus and a high voltage circuit for supplying a bias for forming an image, whereby the toner adheres to the electrostatic latent image on the photosensitive drum 1 and the latent image is developed as a toner image. The toner image on the photosensitive drum 1 is transferred to a transfer material P, such as paper, by a transferring device (transferring means) 5 rotated in the direction of arrow R5. The transfer material P is kept in a sheet feeding cassette (not shown), and is fed by a sheet feeding roller (not shown) and is sent to the transfer nip portion $N_2$ between the photosensitive drum 1 and the transferring device 5 in synchronism with the toner image on the photosensitive drum 1 by registration rollers 9. The toner image transferred to the transfer material P is conveyed to a fixing device 7 with the transfer material P, and there it is heated and pressed and thereby fixed on the transfer material P, and becomes a recorded image. On the other hand, any toner remaining on the photosensitive drum 1 without being transferred to the transfer material P after the transfer of the toner image (hereinafter referred to as the "untransferred toner") is removed by a cleaning blade 6*a* in a cleaning device (cleaning means) 6. The photosensitive drum 1, after the untransferred toner on the surface thereof has been removed, is used for the next cycle of image formation beginning with the charging by the charging device 2, and repeats the above-described series of image forming processes.

Recently, with the spread of computers, electrophotographic recording apparatuses have come to be used as the output apparatuses thereof in various countries of the world. Therefore, it is required that images of high quality be obtained even in an environment of high temperature and high humidity. Also, a variety of transfer materials are used in various countries and therefore, it is desired for an electrographic recording apparatus to be able to be adapted thereto.

At present, as a serious problem in the environment of high temperature and high humidity, there is the problem of a smeared image (smudging). This smeared image may sometimes occur also by dew condensation on the surface of the photosensitive drum, but often occurs because talc, contained in the transfer material, adheres to the surface of the photosensitive drum, oxides due to ozone produced from the charging device, and combines with the moisture from high humidity to create a low resistance substance which disturbs, the latent image. The smeared image may also occur due to the interfacial active agent on the surface of the OHP sheet adhering to the formed image.

As a measure for removing the above-mentioned low resistance substance, it is conceived to reduce the molecular weight of binding resin on the surface layer of the photosensitive drum, and increase the amount of friction during cleaning. However, if the molecular weight of the binding resin is reduced, the surface of the photosensitive drum becomes liable to be roughened when it is frictionally contacted, and this leads to poor cleaning in which, particularly at a low temperatures, the toner rubs through with the hardened cleaning blade, thereby rendering it difficult for the prevention of a smeared image to be compatible with cleaning at a low temperatures.

As an image forming apparatus in which the above-described smeared image is prevented, there is an image forming apparatus described, for example, in Japanese Patent Application Laid-Open No. 62-160458. The photosensitive layer of an electrophotographic photosensitive member contains therein at least one kind of polycarbonate resin having a number average molecular weight of $1.5\times10^4$ or less and at least one kind of polycarbonate resin having a number average molecular weight of $4.5\times10^4$ or greater. The polycarbonate resin having a number average molecular weight of $1.5\times10^4$ or less is contained at a rate of 30 to 95 parts by weight in a composition comprising polycarbonate resin having a number average molecular weight of $1.5\times10^4$ or less and polycarbonate resin having a number average molecular weight of $4.5\times10^4$ or greater.

However, even when the construction as described in Japanese Patent Application Laid-Open No. 62-160458 was adopted, the cleaning property like that of the present invention could not be obtained.

SUMMARY OF THE INVENTION

It is an object of the present invention to provide a cleaning member and an image forming apparatus capable of achieving compatibility between the prevention of a smeared image and the prevention of poor cleaning at low temperatures, and a process cartridge detachably attachable on the image forming apparatus.

It is another object of the present invention to provide a process cartridge having an image bearing member and a cleaning blade member elastically abutted against the image bearing member for cleaning or removing any foreign material adhering to the image bearing member, wherein polycarbonate resin having a viscosity average molecular weight of $1.5\times10^4$ or less is blended with the surface layer of the image bearing member, and the peak value of tan δ of the dynamic viscoelastic characteristic of the cleaning blade member appears at 12° C. or less.

It is still another object of the present invention to provide an image forming apparatus having an image bearing member for bearing a toner image thereon, transferring means for transferring the toner image on the image bearing member to a recording material, fixing means for fixing the toner image on the recording material onto the recording material, and a cleaning blade member elastically abutted against the image bearing member for cleaning any foreign material adhered to the image bearing member, wherein polycarbonate resin having a viscosity average molecular weight of $1.5\times10^4$ or less is blended with the surface layer of the image bearing member, and the peak value of tan δ of the dynamic viscoelastic characteristic of the cleaning blade member appears at 12° C. or less.

It is yet still another object of the present invention to provide a cleaning member having an elastic blade member wherein a peak value of tan δ of the dynamic viscoelastic characteristic appears at 12° C. or less.

Further objects of the present invention will become apparent from the following description.

BRIEF DESCRIPTION OF THE DRAWINGS

FIG. 7 compares Embodiment 1 with comparative examples 1 to 5.

DESCRIPTION OF THE PREFERRED EMBODIMENTS

Some embodiments of the present invention will hereinafter be described with reference to the drawings.

Embodiment 1

In this embodiment, the surface layer of a drum type electrophotographic photosensitive member (photosensitive drum) 1 as an image bearing member contains therein at least one kind of polycarbonate resin (I) having a viscosity average molecular weight of $1.5\times10^4$ or less and at least one kind of polycarbonate resin (II) having a viscosity average molecular weigh of $1.5\times10^4$ or greater. Also, this embodiment is characterized in that the above-mentioned polycarbonate resin (I) is contained at a rate of 30 to 95 parts by weight in a composition comprising the polycarbonate resin (I) and the polycarbonate resin (II), and that the cleaning blade 6*a* of cleaning means 6 is a cleaning blade using urethane elastomer and the peak value of tanδ of the dynamic viscoelastic characteristic thereof appears at 12° C. or less.

Thus, the surface layer of the photosensitive drum 1 has a moderate friction property, whereby a smeared image can be prevented. Also, the cleaning blade 6*a* can keep sufficient elasticity even at low temperatures, therefore good cleaning can be effected even when the surface roughness becomes great by friction when the above-described photosensitive drum 1 is used.

A description will hereinafter be provided in detail.

Figure 1:
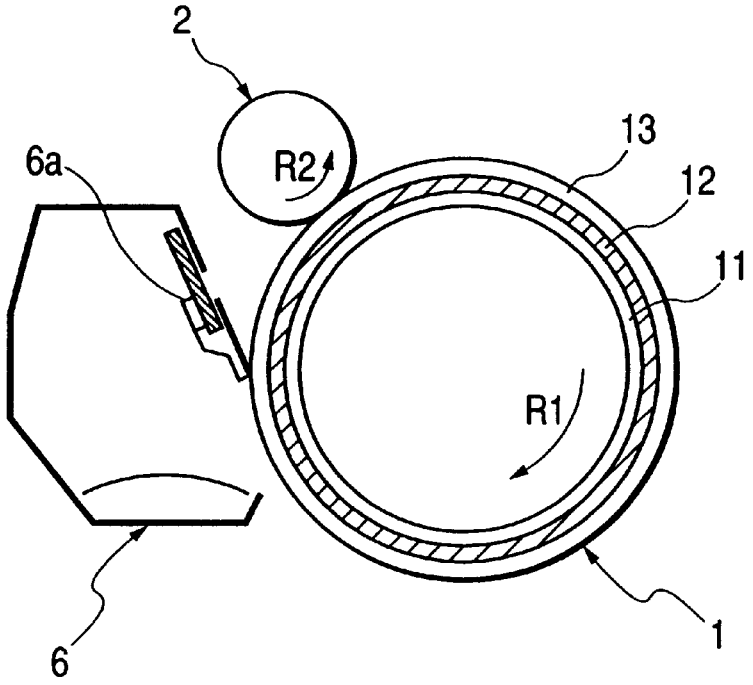
FIG. 1 is a vertical cross-sectional view showing the construction around a photosensitive drum in Embodiment 1.

FIG. 1 is a vertical cross-sectional view showing the construction of the photosensitive drum 1 and the cleaning blade 6*a* in the present embodiment.

The photosensitive drum 1 shown in FIG. 1 is provided with a base body 11, a charge generating layer 12 and a charge transporting layer 13 in succession from the inside thereof, and the charge generating layer 12 and the charge transporting layer 13 together constitute a photosensitive layer.

As the base body 11, use is made of a cylinder or film of a metal such as aluminum or stainless steel, paper, plastic or the like. In the present embodiment, use is made of an aluminum cylinder having a diameter of 30 mm.

The charge generating layer 12 is formed by a charge generating pigment being well dispersed with finder resin 0.5 to 4 times as great in quantity as the pigment, and a solvent by a method using a homogenizer, an ultrasonic wave, a ball mill, a vibration ball mill, a sand mill, an attritor, a roll mill or the like, and applied and dried. The thickness of the charge generating layer 12 is of the order of 0.1 to 1 μm.

The charge transporting layer 13 is formed by a substance having a charge transporting property and a blended composition of the aforementioned polycarbonate resin (I) and polycarbonate resin (II) being dissolved in a solvent and applied onto the charge generating layer 12. The mixture ratio of the substance having a charge transporting property and the polycarbonate resin blended composition is 2:1 to 1:2. As the solvent, use is made of a ketone, such as cyclohexane or the like, an ester such as methyl acetate ethyl acetate or the like, an ether, such as THF or the like, or a chlorine hydrocarbon, such as chlorobenzene, chloroform, or carbon tetrachloride.

In the present embodiment, the charge transporting layer 13 has been formed by a substance having a charge transporting property, and a composition adapted to contain polycarbonate resin having a viscosity average molecular weight of $5\times10^3$ and 40 parts by weight of polycarbonate resin having a viscosity average molecular weight of $2\times10^4$.

Generally the strength (friction resistance and hardness) of resin becomes higher with an increase in the molecular weight thereof, but after a certain molecular weight is reached, even if the molecular weight is increased, the strength will no longer become greater and will exhibit a constant value. On the other hand, as the molecular weight becomes lower, the strength is gradually reduced and after a certain molecular weight or lower is reached, the strength is suddenly reduced. In the case of polycarbonate resin, the molecular weight for which the strength is suddenly reduced is 1.5 to $2.0\times10^4$ and therefore, by containing resin of a molecular weight lower than this to a certain degree, a moderate friction property can be imparted.

Thereby, a low resistance adhering substance is always removed from the surface of the photosensitive layer by minute wear and the surface is kept clean and therefore, the deterioration of the quality of image can be prevented.

However, the surface which does not contain a low molecular weight component tends to become weak to a mechanical extraneous force, such as friction, and particularly tends to be disadvantageous for the cleaning property at low temperatures.

The composition ratio of the blended composition of polycarbonate resin (I) and polycarbonate resin (II) in the present invention may preferably be such that polycarbonate resin (I) having a number average molecular weight of $1.5\times10^4$ or less is at a rate of 30 to 95 parts by weight to the aforedescribed blended composition. If polycarbonate resin (I) is less than 30 parts by weight, a moderate friction property will not be imparted and the effect as previously described will not be found. On the other hand, if polycarbonate resin (I) exceeds 95 parts by weight, there will be the problems of an excessive friction property and a reduction in viscosity. Also, it is preferable that the molecular weight of polycarbonate resin (I) be $1.5\times10^4$ or less for which a sudden change in strength occurs as described previously.

Here, the number average molecular weight and composition ratio of the photosensitive layer can be analyzed by the following method.

A sample of 0.5 g is accurately weighed and dissolved in 100 ml of methylene chloride, and the specific viscosity of this solution at 25° C. is measured by the use of an improved Ubbelohde's viscometer. The limiting viscosity is found from this specific viscosity, and an average molecular weight is calculated by Mark-Houwink's viscosity expression. Also, the composition ratio can be found by GPC (gas permutation chromatoglaphy).

Figure 6:
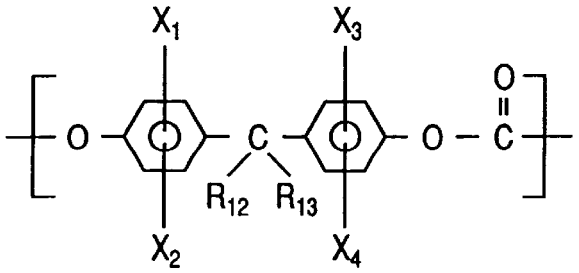
FIG. 6 shows a repetition unit shown by a general formula of polycarbonate resin.

Polycarbonate resin used in the present invention contains a linear polymer having one or two or more kinds of repetition unit shown in the general expression [A] of FIG. 6 as a component. In the expression, $R_{12}$ and $R_{13}$ are a hydrogen atom and alkyl group, or aromatic group respectively. Also, $R_{12}$ and $R_{13}$ together may form an annular structure with the coupled carbon atoms. $X_1$, $X_2$, $X_3$ and $X_4$ represent a hydrogen atom, a halogen atom, alkyl group and aryl group, respectively.

As a substance having a charge transporting property, mention may be made of a triaryl amine compound, a hydrazone compound, a stilbene compound, a pyrazoline compound, an oxazole compound, a triallyl methane compound, a thiazole compound or the like.

The cleaning blade 6*a* used in the present embodiment will now be described in detail.

In order to maintain a good cleaning property at low temperatures, a urethane elastomer is used in which the peak temperature of the tanδ, which is one of the dynamic viscoelastic characteristics, is set at 12° C. or less so as to keep a sufficient elasticity even at low temperatures. This this cleaning blade is used in combination with the aforedescribed photosensitive drum 1, whereby a smeared image is prevented and the follow-up property at low temperatures relative to the unevenness of the surface of the photosensitive drum 1 is good and therefore, poor cleaning can be prevented.

In the measurement of the tanδ peak temperature, by a dynamic visco-elasticity measuring machine RSAII (Soft: Rhios) produced by Rheometrics Fareast Inc., a urethane rubber test piece (cross-section: 1.5 mm×6 mm, length: 22.5 mm) was fixed to the measuring machine at a location of 6 mm from the opposite ends thereof, tension of a constant load (200 g) was applied thereto, and distortion was applied at a frequency of 10 Hz, whereby the stress created in the test piece was measured, and it was decomposed into elastic stress, and the storage modulus of elasticity E' and the loss modulus of elasticity E" were calculated from these, and a value obtained by dividing E" by E' was found as the tanδ value, and the tanδ value at each temperature was measured while the temperature was raised from a low temperature range to a high temperature range at 0.1° C./min., and a temperature exhibiting a maximum value was determined as the tanδ peak temperature. The distortion applied to the urethane rubber test piece is created by adding tension of ±a g at a cycle of 10 Hz to the tension of 200 g applied in advance, and the value of a g is varied by the measured temperature, and is set in an auto strain mode.

Generally, the modulus of elasticity of elastomer has a temperature dependency.

Figure 2:
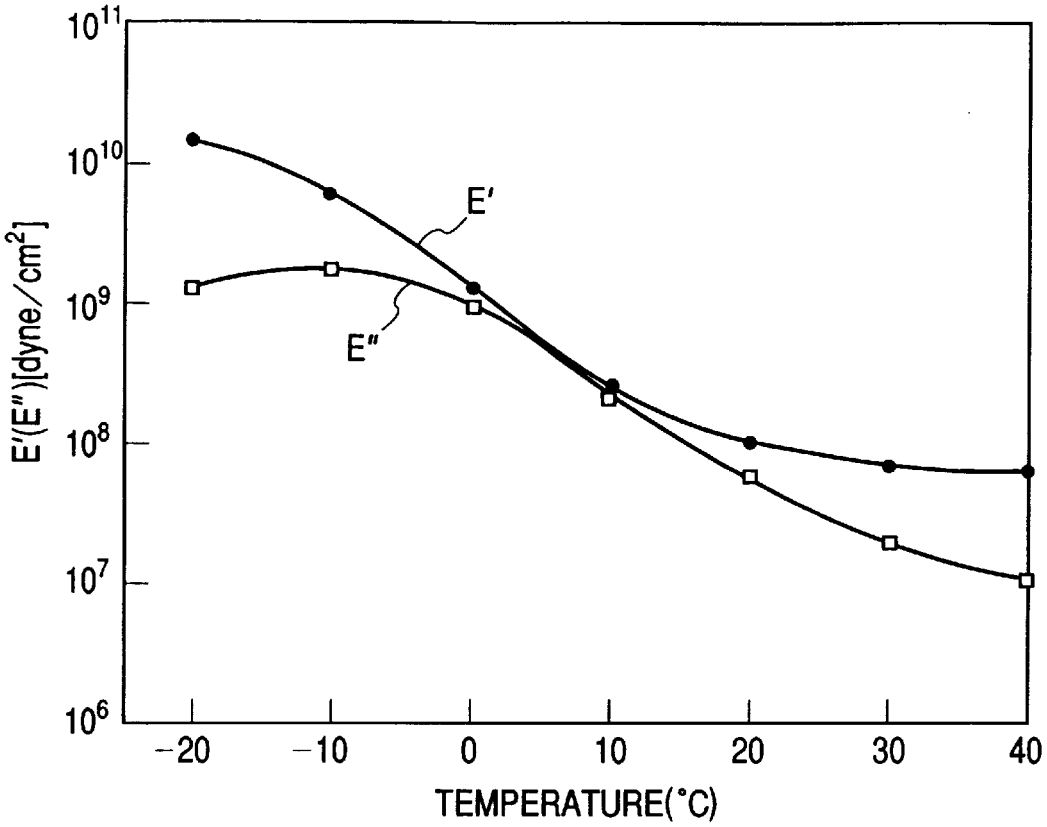
FIG. 2 is a graph showing the temperature dependency of the storage modulus of elasticity E' and the loss modulus of elasticity E" of the urethane elastomer of a cleaning blade.
Figure 3:
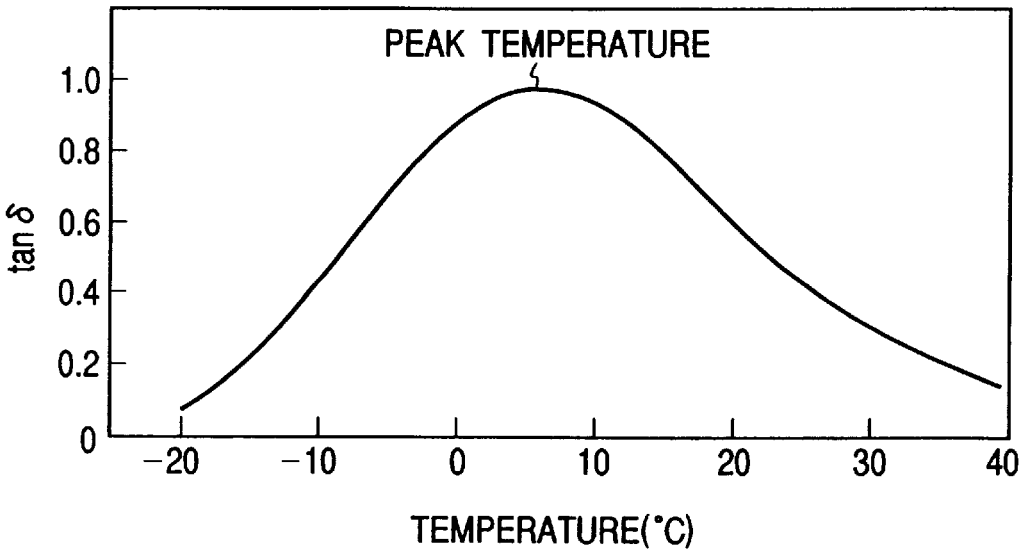
FIG. 3 is a graph showing the temperature dependency of tanδ of the cleaning blade.

FIG. 2 shows the temperature dependency of the storage modulus of elasticity E' and loss modulus of elasticity E" of urethane elastomer. FIG. 3 shows the temperature dependency of tanδ which is a value obtained by dividing E" by E'.

Urethane elastomer tends to increase its hardness remarkably and lose its elasticity more at temperatures lower than the temperature of the characteristic tanδ peak value, than at temperatures higher than that. As the result, the capability of removing the residual toner on the photosensitive drum 1 is lost. Accordingly, by making the tanδ peak temperature equal to or lower than 12° C., the cleaning function can be maintained even in a low temperature environment. The tanδ peak temperature may preferably be 0° C. or higher because if it is below 0° C., hardness tends to become too high. In the present embodiment, urethane elastomer having a tanδ peak temperature of 8° C. was used, as shown in FIG. 3.

Urethane elastomer used in the cleaning blade 6*a* according to the present invention may be synthesized by various methods, but a typical synthesizing method is a method of causing prepolymer, obtained by causing diisocyanate to react with polyester diol obtained from dicarboxylic acid, and diol and a hardening agent composition containing trimethylole propane, to react with each other.

As dicarboxylic acid, use is made of saturated or unsaturated dibasic acid such as adipic acid, sebacic acid, terephthalic acid, isophthalic acid, maleic acid or fumaric acid, acid anhydride, such as maleic acid anhydride or phthalic anhydride, or dialkyl ester such as terephthalic acid dimethyl or the like.

As diol, use is made of glycol such as ethylene glycol, butylene glycol, propylene glycol, diethylene glycol, dipropylene glycol neopentyl glycol or 1, 6-hexylene glycol.

As diisocyanate, use is made of 4, 4'-diphenyl methane diisocyanate (MDI), hexamethylene diisocyanate, isophorone diisocyanate, 4, 4'-dicyclohexyl methane diisocyanate, 2, 4-tolylene diisocyanate (2, 4-TDI), 2, 6-tolylenediisocyanate (2, 6-TDI), carbon diimide denatured MDI, polymethylene polyphenyl polyisocyanate (PAPI), ortho-toluidine diisocyanate (TODI), naphthylene diisocyanate (NDI), xylylene diisocyanate (XDI) or the like.

Also, as the hardening agent used with trimethylole propane as required, use is made of 1, 4-butylene glycol, ethylene glycol, diethylene glycol, propylene glycol, dipropylene glycol, hexanediole, glyceline, pentaerythritol, sorbitol, 1, 4-cyclohexanediole, 1, 4-cyclohexane dimethanol, xylylene glycol or the like.

Among these starting materials, urethane elastomer, obtained by causing 1, 4-butanediole and trimethylole propane to react with prepolymer obtained by further causing 4, 4'-diphenyl methane diisocyanate to react with polyester diole obtained by causing adipic acid and at least one glycol chosen from ethylene glycol and butylene glycol to react with each other, is particularly suitable.

Figure 5:
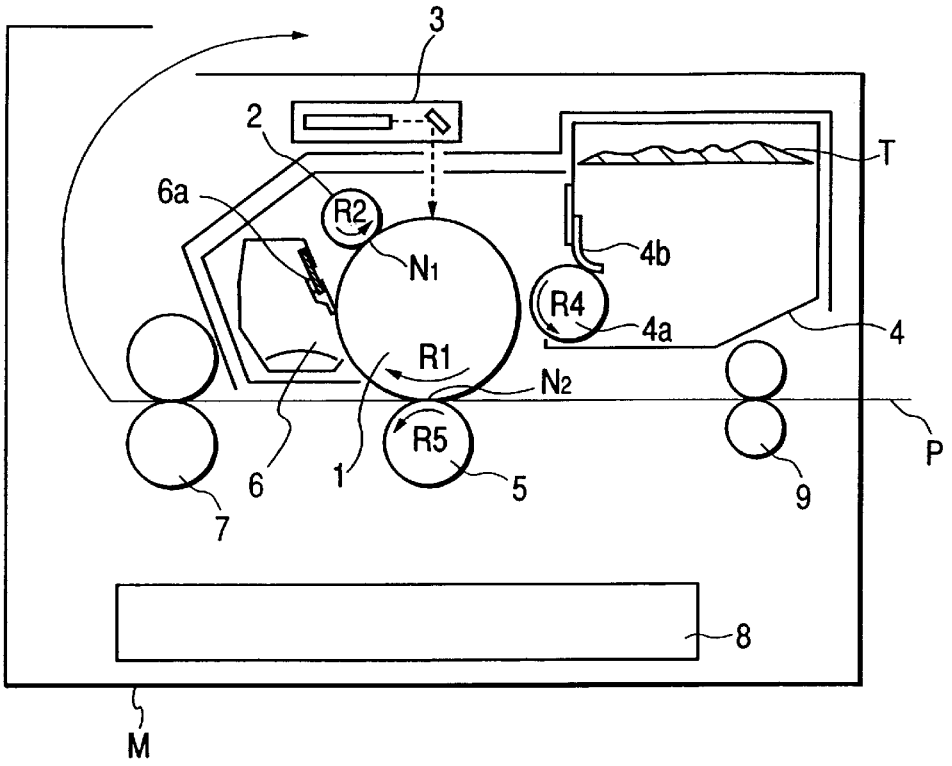
FIG. 5 is a vertical cross-sectional view schematically showing the basic construction of an image forming apparatus.

The photosensitive drum 1 and cleaning blade 6*a* of the construction as described above were applied to an image forming apparatus shown in FIG. 5, and a continuous endurance test was effected for an image of 4% print proportion in a high temperature and a high humidity environment (hereinafter referred to as the "H/H environment") of a temperature 32.5° C. and a relative humidity 80%, and an evaluation of a smeared image was performed.

The result was such that the smeared image did not occur throughout the endurance test of 10,000 sheets and good images were obtained.

Also, a continuous endurance test of 25,000 sheets was effected for an image of 1% print percentage in a low temperature and a low humidity environment (hereinafter referred to as "L/L environment") of a temperature of 15° C. and a relative humidity of 10%, and an evaluation of the presence or absence of the occurrence of poor cleaning was performed.

The result was such that poor cleaning did not occur throughout the endurance of 25,000 sheets.

When in this case, the surface roughness of the photosensitive drum 1 was measured at the end of the endurance, the ten-point average roughness Rz (measured according to JIS surface roughness B0601 and with 2.5 mm as the measurement length) was 1.3 $\mu$m.

With respect to Comparative Example 1 to Comparative Example 5 shown below, the evaluation of the smeared image by the continuous endurance in the H/H environment, the evaluation of the cleaning property in the continuous endurance in the L/L environment and the measurement of the surface roughness of the photosensitive drum 1 thereafter were effected.

Comparative Example 1

(1) photosensitive drum 1 . . . the binding resin of the charge transporting layer 13 was designed to comprise only polycarbonate resin of a viscosity average molecular weight of $5\times10^3$.

(2) cleaning blade 6*a* . . . this was formed of urethane elastomer having a tanδ peak temperature of 8° C.

Comparative Example 2

(1) photosensitive drum 1 . . . the binding resin of the charge transporting layer 13 was designed to comprise only polycarbonate resin having a viscosity average molecular of weight of $2\times10^4$.

(2) cleaning blade 6*a* . . . this was formed of urethane elastomer having a tanδ peak temperature of 8° C.

Comparative Example 3

(1) photosensitive drum 1 . . . the binding resin of the charge transporting layer 13 was designed to comprise only polycarbonate resin having a viscosity average molecular weight of $5\times10^3$.

(2) cleaning blade 6*a* . . . this was formed of urethane elastomer having a tanδ peak temperature of 16° C.

Comparative Example 4

(1) photosensitive drum 1 . . . the binding resin of the charge transporting layer 13 was designed to comprise only polycarbonate resin having a viscosity average molecular weight of $2\times10^4$.

(2) cleaning blade 6*a* . . . this was formed of urethane elastomer having a tanδ peak temperature of 16° C.

Comparative Example 5

(1) photosensitive drum 1 . . . the binding resin of the charge transporting layer 13 was designed to contain 40 parts by weight of polycarbonate resin of a viscosity average molecular weight $5\times10^3$ and polycarbonate resin of a viscosity average molecular weight of $2\times10^4$.

(2) cleaning blade 6*a* . . . this was formed of urethane elastomer having a tanδ peak temperature of 16° C.

The results of the above mentioned Embodiment 1 and Comparative Examples 1 to 5 are shown in FIG. 7.

In Embodiment 1, the surface layer of the photosensitive drum 1 has a moderate friction property, whereby a smeared image did not occur and good images were obtained. Also, the cleaning blade 6*a* does not become very hard even at low temperatures and keeps sufficient rubber elasticity and therefore, when it frictionally contacts the photcsensitive drum 1, it can effect fine vibration and therefore, the surface layer of the photosensitive drum 1 is uniformly shaved off as fine shaving powder. As a result, it is difficult for the surface roughness of the photosensitive drum 1 to become great. In addition, the cleaning blade 6*a* maintain, a follow-up property even at low temperatures and can, therefore effect good cleaning.

In Comparative Example 1, polycarbonate resin of a viscosity average molecular weight of $5\times10^3$ was used as the binding resin of the charge transporting layer 13 of the photosensitive drum 1 and therefore, the friction property became high and a smeared image did not occur. On the other hand, the friction property was too high and therefore, in the endurance test in the L/L environment, the surface roughness Rz of the photosensitive drum 1 became as great as 2.7 $\mu$m, and poor cleaning occurred at 7000 sheets.

In Comparative Example 2, polycarbonate resin of a molecular weight $2\times10^4$ was used for the photosensitive drum 1 and therefore, a smeared image occurred at 4000 sheets. Due to being originally a surface layer difficult to shave off, in the endurance test in the L/L environment, the surface roughness Rz of the photosensitive drum 1 was 0.7 $\mu$m and the cleaning property was good.

In Comparative Example 3, polycarbonate resin of a molecular weight $5\times10^3$ was used for the photosensitive drum 1 and therefore, a smeared image did not occur, but yet in the endurance test in the L/L environment, the surface roughness Rz of the photosensitive drum 1 was 3.1 $\mu$m, the largest value in the series of experiments, and poor cleaning occurred at 1000 sheets. This is considered to have occured because the molecular weight is low, and thus, the surface of the photosensitive drum 1 becomes liable to be roughened by frictional contact during the endurance test and in addition, a blade having a tanδ peak temperature of 16° C. is used as the cleaning blade 6*a* and therefore, it becomes hard at low temperatures and fine vibration cannot be effected and thus, greater shaving of the surface of the photosensitive drum 1 occurs and therefore, the surface roughness thereof becomes great and the follow-up property of the cleaning blade 6*a* to the photosensitive drum 1 becomes bad, whereby poor cleaning was caused at the smallest number of sheets among the comparative examples.

Comparing Comparative Examples 1 and 3 with each other, the number of sheets until poor cleaning occurs in the endurance test in the L/L environment is considerably greater in Comparative Example 1 than in Comparative Example 3. This is considered to be due to the fact that the cleaning blade in Comparative Example 1 keeps elasticity sufficient even at low temperatures and can follow up even if the unevenness of the surface of the photosensitive drum is more or less great. Of course, it is also considered to be attributable to the fact that the surface of the photosensitive drum is shaved by the small-amplitude fine vibration of the cleaning blade in Comparative Example 1 and therefore the surface roughness Rz is smaller than in Comparative Example 3.

In Comparative Example 4, all of the smeared image, the poor cleaning and the drum surface roughness Rz ended in the same results as those in Comparative Example 2.

In Comparative Example 5, the surface layer of the photosensitive drum 1 has a moderate friction property, whereby the smeared image did not occur and good images were obtained, but in the endurance test in the L/L environment, poor cleaning occurred at 8000 sheets. This occured for the following reason. The cleaning blade 6*a* becomes hard at low temperatures and loses sufficient rubber elasticity and therefore becomes unable to effect fine vibration. Polycarbonate resin of a low molecular weight component is contained in the surface layer of the photosensitive drum 1 and thus, is shaved off as large shaving powder, and the surface roughness of the photosensitive drum 1 becomes somewhat great. In addition, the follow-up property of the cleaning blade 6*a* is spoiled at low temperatures and therefore, the cleaning property becomes worse than in Embodiment 1.

From the above-described result, there is achieved the effect that by the combination of the photosensitive drum 1 and the cleaning blade 6*a* as in the present embodiment, the surface layer of the photosensitive drum 1 has a moderate friction property, whereby a smeared image can be prevented. Also, the cleaning blade 6*a* can maintain sufficient elasticity even at low temperatures and can therefore effect fine vibration of a small amplitude during its frictional contact with the photosensitive drum 1 when the above-described photosensitive drum 1 is used and thus, the surface layer of the photosensitive drum 1 is uniformly shaved off as fine shaving powder and therefore it is difficult for the surface roughness to become great and the follow-up property of the cleaning blade 6*a* is good and the surface of the photosensitive drum is cleaned well.

Embodiment 2

Figure 4:
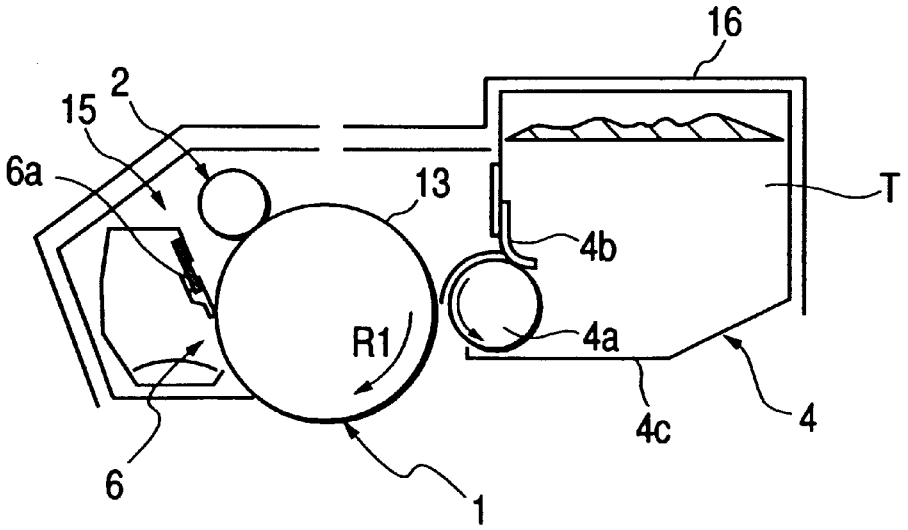
FIG. 4 is a vertical cross-sectional view showing the construction of a process cartridge in Embodiment 2.

FIG. 4 shows a vertical cross-sectional view of a process cartridge taken in a direction perpendicular to the axis of the photosensitive drum.

The feature of the present embodiment is that the photosensitive drum 1 and cleaning blade 6*a* described in Embodiment 1 are integrally incorporated into a cartridge container 15 to thereby construct a process cartridge detachably attachable with respect to the main body of an image forming apparatus. In the process cartridge 16 shown in FIG. 4, the photosensitive drum 1, the charging device 2, the developing device 4 and the cleaning device 6 are integrated to thereby construct the process cartridge 16.

This process cartridge 16 is mounted on the main body of an image forming apparatus provided with a power source for driving the photosensitive drum 1, etc., and a high voltage circuit for supplying a bias for forming an image, and a toner image is formed on the photosensitive drum 1.

The toner image formed on the photosensitive drum 1 is transferred to a transfer material P by the transferring device 5 (see FIG. 5) provided in the main body of the image forming apparatus, and is fixed by the fixing device 7.

Any untransferred toner remaining on the photosensitive drum 1 without being transferred to the transfer material P is removed by the cleaning blade 6*a* in the cleaning device 6 in the process cartridge 16.

As a result, the provision of a process cartridge which has the effect described in Embodiment 1, prevents the occurence of a smeared image and at the same time has a good cleaning property whose maintenance is unnecessary becomes possible.

While the embodiments of the present invention have been described above, the present invention is restricted to the above-described embodiments in no way, but all modifications are possible within the technical idea of the present invention.

What is claimed is:

1. A process cartridge detachably attachable on an image forming apparatus, said process cartridge comprising:

an image bearing member; and a cleaning blade member elastically abutted against said image bearing member for cleaning foreign substances adhering to said image bearing member, wherein polycarbonate resin having a viscosity average molecular weights of $1.5\times10^4$ or less is blended with a surface layer of said image bearing member, and a peak value of tan δ of a dynamic viscoelastic characteristic of said cleaning blade member appears at 12° C. or less, wherein the tan δ is a value obtained by dividing a loss modulus of elasticity of said cleaning blade member by a storage modulus of elasticity of said cleaning blade member.

2. A process cartridge according to claim 1, wherein polycarbonate resin having a viscosity average molecular weight of $1.5\times10^4$ or greater is also blended with the surface layer of said image bearing member.

3. A process cartridge according to claim 2, wherein a rate at which polycarbonate resin having a viscosity average molecular weight of $1.5\times10^4$ or less is contained in the blended composition of polycarbonate resin having a viscosity average molecular weight of $1.5\times10^4$ or less and polycarbonate resin having a viscosity average molecular weight of $1.5\times10^4$ or greater in the surface layer of said image bearing member is 30 to 95 parts by weight.

4. A process cartridge according to claim 1, wherein the surface layer is a photosensitive layer.

5. A process cartridge according to claim 1, wherein said image bearing member is a rotatable member.

6. A process cartridge according to claim 1, wherein said cleaning blade member is supported by a support member, and an end portion supported by the support member of said cleaning blade member is located upstream of a portion abutted against said image bearing member with respect to the direction of movement of said image bearing member.

7. A process cartridge according to claim 1, wherein said cleaning blade member is formed of urethane elastomer.

8. A process cartridge according to claim 1, wherein said cleaning blade member is supported by a support member, and an end portion supported by the support member of said cleaning blade member is located downstream of a portion abutted against said image bearing member in a direction of movement of said image bearing member.

9. An image forming apparatus comprising:

an image bearing member for bearing a toner image;

transferring means for transferring the toner image on said image bearing member to a recording material;

fixing means for fixing the toner image on the recording material onto the recording material; and a cleaning blade member elastically abutted against said image bearing member for cleaning foreign substances adhering to said image bearing member, wherein polycarbonate resin having a viscosity average molecular weight of $1.5\times10^4$ or less is blended with a surface layer of said image bearing member, and a peak value of tan δ of the dynamic viscoelastic characteristic of said cleaning blade member appears at 12° C. or less, wherein tan δ is a value obtained by dividing a loss modulus of elasticity of said cleaning blade member by a storage modulus of elasticity of said cleaning blade member.

10. An image forming apparatus according to claim 9, wherein said image bearing member and said cleaning blade member are provided in a unit which is detachably attachable on said image forming apparatus.

11. An image forming apparatus according to claim 9, wherein polycarbonate resin having a viscosity average molecular weight of $1.5\times10^4$ or greater is also blended with the surface layer of said image bearing member.

12. An image forming apparatus according to claim 9, wherein a rate at which polycarbonate resin having a viscosity average molecular weight of $1.5\times10^4$ or less is contained in the blended composition of polycarbonate resin having a viscosity average molecular weight of $1.5\times10^4$ or less and polycarbonate resin having a viscosity average molecular weight of $1.5\times10^4$ or greater in the surface layer of said image bearing member is 30 to 95 parts by weight.

13. An image forming apparatus according to claim 9, wherein the surface layer is a photosensitive layer.

14. An image forming apparatus according to claim 9, wherein said image bearing member is a rotatable member.

15. An image forming apparatus according to claim 9, wherein said cleaning blade member is supported by a support member, and an end portion supported by the support member of said cleaning blade member is located upstream of a portion abutted against said image bearing member with respect to the direction of movement of said image bearing member.

16. An image forming apparatus according to claim 9, wherein said cleaning blade member is formed of urethane elastomer.

17. An image forming apparatus according to claim 9, wherein said cleaning blade member is supported by a support member, and an end portion supported by the support member of said cleaning blade member is located downstream of a portion abutted against said image bearing member in a direction of movement of said image bearing member.

18. A cleaning member comprising an elastic blade member, wherein a peak value of tan δ of the dynamic viscoelastic characteristic of said elastic blade member appears at 12° C. or less, wherein tan δ is a value obtained by dividing a loss modulus of elasticity of said elastic blade member by a storage modulus of elasticity of said elastic blade member.

19. A cleaning member according to claim 18, wherein said elastic blade member abuts against an image bearing member provided with a surface layer with which polycarbonate resin having a viscosity average molecular weight of $1.5\times10^4$ or less, is blended for cleaning said image bearing member.

20. A cleaning member according to claim 18, wherein said elastic blade member is formed of urethane elastomer.

* * * * *

UNITED STATES PATENT AND TRADEMARK OFFICE

CERTIFICATE OF CORRECTION

PATENT NO. : 6,128,462
DATED : October 3, 2000
INVENTOR(S) : Junichi Kato et al.

It is certified that error appears in the above-identified patent and that said Letters Patent is hereby corrected as shown below:

Title page,
Item [57] ABSTRACT,
Line 2, "apparatus a" should read -- apparatus includes a --.
Line 2, "member" (second occurrence) should read -- member of --.

Drawings,
Sheet 4, Figure 7, "OCCURRS" (all occurrences) should read -- OCCURS --.

Column 1,
Line 40, "supplied" should read -- applied --.

Column 2,
Line 11, "electrographic" should read -- electrophotographic --.
Line 21, "substance." should read -- substance, --.
Line 22, "disturbs," should read -- disturbs --.
Line 33, "temperatures" should read -- temperature --.
Line 36, "temperatures." should read -- temperature. --.

Column 4,
Line 8, "therefore" should read -- and therefore --.
Line 42, "acetate" should read -- acetate, --.

Column 5,
Line 32, "chromatoglaphy)." should read -- chromatography). --.
Line 35, "unit" should read -- units --.

Column 6,
Line 2, "clastic" should read -- elastic --.

Column 8,
Line 15, "above mentioned" should read -- above-mentioned --.
Line 27, "maintain," should read -- maintains --.
Lines 40 and 47, "weight" should read -- weight of --.

Column 10,
Line 25, "weights" should read -- weight --.

Column 11,
Line 17, "unit" should read -- unit, --.

UNITED STATES PATENT AND TRADEMARK OFFICE

CERTIFICATE OF CORRECTION

PATENT NO. : 6,128,462
DATED : October 3, 2000
INVENTOR(S) : Junichi Kato, et al.

It is certified that error appears in the above-identified patent and that said Letters Patent is hereby corrected as shown below:

Column 12,
Line 28, "resin" should read -- resin, --.

Signed and Sealed this

Fourth Day of December, 2001

*Attest:*

Nicholas P. Godici

*Attesting Officer*

NICHOLAS P. GODICI
*Acting Director of the United States Patent and Trademark Office*